US008918982B2

(12) United States Patent
Hagedorn et al.

(10) Patent No.: US 8,918,982 B2
(45) Date of Patent: Dec. 30, 2014

(54) METHOD FOR THE PRODUCTION OF A HIGH-PRESSURE ACCUMULATOR PIPE OF STEEL FOR FUEL INJECTION SYSTEMS AND HIGH-PRESSURE ACCUMULATOR PIPE PRODUCED ACCORDING TO THIS METHOD

(75) Inventors: Michael Hagedorn, Dortmund (DE); Uwe Lechtenfeld, Dortmund (DE)

(73) Assignee: Salzgitter Mannesmann Precision GmbH, Hamm (DE)

( * ) Notice: Subject to any disclaimer, the term of this patent is extended or adjusted under 35 U.S.C. 154(b) by 1514 days.

(21) Appl. No.: 12/528,168

(22) PCT Filed: Jan. 10, 2008

(86) PCT No.: PCT/DE2008/000041
§ 371 (c)(1),
(2), (4) Date: Nov. 5, 2010

(87) PCT Pub. No.: WO2008/106911
PCT Pub. Date: Sep. 12, 2008

(65) Prior Publication Data

US 2011/0041946 A1 Feb. 24, 2011

(30) Foreign Application Priority Data

Mar. 7, 2007 (DE) ..... 10 2007 011 868

(51) Int. Cl.

| | |
|---|---|
| ***B21D 39/00*** | (2006.01) |
| ***F02M 55/02*** | (2006.01) |
| ***B21C 37/15*** | (2006.01) |
| ***B21D 39/06*** | (2006.01) |
| ***B21K 25/00*** | (2006.01) |

(52) U.S. Cl.
CPC ..... *B21D 39/06* (2013.01); *F02M 55/025* (2013.01); *B21C 37/154* (2013.01); *F02M 2200/9053* (2013.01); *F02M 2200/80* (2013.01); *B21K 25/00* (2013.01)
USPC ..... 29/507

(58) Field of Classification Search
CPC .... B21K 25/00; B21C 37/154; F02M 55/025; F02M 2200/9053; F02M 2200/80; B21D 39/06
USPC ..... 29/516, 507, 506, 505, 428; 138/142, 138/140
See application file for complete search history.

(56) References Cited

FOREIGN PATENT DOCUMENTS

| | | |
|---|---|---|
| DE | 197 16 659 A1 | 11/1997 |
| DE | 198 08 012 A1 | 8/1998 |

(Continued)

*Primary Examiner* — John C Hong
(74) *Attorney, Agent, or Firm* — Henry M. Feiereisen LLC

(57) ABSTRACT

In a method of making a high-pressure accumulator pipe as composite pipe of steel for pressures of up to 1800 bar and above with high static strength and fatigue strength for fuel injection systems with common rail systems for internal combustion engines, a first inner pipe part is inserted into a second outer pipe part with little clearance, and the inner pipe part is connected to the outer pipe part gap-free and by interference fit through mechanical forming. The mechanical forming includes a rolling-in process, wherein the inner pipe part is subjected to a ductile expansion and the outer pipe part is subjected to an elastic expansion using an oversized rolling tool that is moved within the inner pipe part, and wherein a residual compressive stress adjusted to the operating pressure is applied to the inner pipe part after the forming process via the elastic resilience of the outer pipe part.

6 Claims, 2 Drawing Sheets

(56) References Cited

FOREIGN PATENT DOCUMENTS

| | | | |
|---|---|---|---|
| DE | 199 36 685 | A1 | 2/2001 |
| DE | 103 03 853 | A1 | 8/2004 |
| DE | 203 17 565 | | 4/2005 |
| DE | 102004030394 | | 5/2005 |
| EP | 0 028 809 | A | 5/1981 |
| EP | 0 445 904 | A | 9/1991 |
| GB | 2286642 | * | 8/1995 |
| WO | WO2005/070579 | | 8/2005 |

* cited by examiner

METHOD FOR THE PRODUCTION OF A HIGH-PRESSURE ACCUMULATOR PIPE OF STEEL FOR FUEL INJECTION SYSTEMS AND HIGH-PRESSURE ACCUMULATOR PIPE PRODUCED ACCORDING TO THIS METHOD

CROSS-REFERENCES TO RELATED APPLICATIONS

This application is the U.S. National Stage of International Application No. PCT/DE20081000041, filed Jan. 10, 2008, which designated the United States and has been published as International Publication No. WO 2008/106911 and which claims the priority of German Patent Application, Serial No. 10 2007 011 868.8, filed Mar. 7, 2007, pursuant to 35 U.S.C. 119(a)-(d).

BACKGROUND OF THE INVENTION

The invention relates to a method of making a high-pressure accumulator pipe of steel for fuel injection systems as well as to a high-pressure accumulator pipe.

High-pressure accumulator pipes for fuel injection systems of internal combustion engines are also designated as common rail system. Pressure generation and fuel injection are decoupled from one another in the common rail system.

A separate high-pressure pump produces continuously pressure which is stored in the central high-pressure accumulator independently from the injection sequence. High-pressure lines extend from this accumulator to the individual injectors which are associated to the motor cylinders. The built-up pressure is constantly available in the fuel line.

in order to satisfy the high demands on the mechanical properties and the corrosion and cavitation resistances, when the injection pressures of today reach up to 1800 bar, components which assume to a lesser degree a storage function but rather a conducting function, such as the high-pressure fuel lines, e.g. known from the documents DE 203 17 565 U1, DE 198 08 012 C2, and DE 197 16 659 C2, are designed as composite pipes.

These composite pipes include a relatively thin-walled inner pipe part and an relatively thick-walled outer pipe part which are connected to one another via a press-fit. The press-fit is realized for example through cold drawing (DE 197 16 659 C2).

The inner pipe part is made of a high-alloy, corrosion-resistant and high-strength steel as a consequence of the direct contact with the fuel mixture under high pressure, while the outer pipe part is typically made of unalloyed or low-alloy steel.

High-pressure accumulator pipes which do not assume a conducting function but predominantly a storage function, must exhibit a high fatigue strength besides the required mechanical properties in order to be able to withstand the high and pulsating pressures during operation. This requires the presence of a superior inner pipe surface with a very low roughness that cannot be realized using known production methods for high-pressure accumulator pipes. For example, roughness values of $R_z \leq 1.0$ μm and $R_a \leq 0.2$ μm should be reached.

High-pressure accumulator pipes are disclosed e.g. in DE 10 2004 030 394 B3 and DE 199 36 685 A1.

In order to satisfy the high surface demands, it is known to make the high-pressure accumulator pipes from a pipe comprised only of one pipe part through deep drilling of solid material or to use cold-finished, seamless or welded precision steel pipes which are cold-rolled in two draws.

Deep drilling has shortcomings relating to the high material consumption and the complicated deep drilling process. The surface quality and the properties of the marginal drilling zone oftentimes do not meet the demands and the required high fatigue strength can only be realized through an additional autofrettage process.

As cold-finished pipes require two drawing processes, high costs are incurred and the pipes oftentimes exhibit insufficient surface quality and inadequate properties at the marginal zones, and the application of a cost-intensive autofrettage is also necessary. DE 103 03 853 A1 discloses a high-pressure accumulator pipe which involves a composite pipe of two pipe parts which are connected to one another through heat application and shrinkage. This is also disadvantageous because the inner pipe part produced by deep drilling.

SUMMARY OF THE INVENTION

It is an object of the invention to provide a method of making a high-pressure accumulator pipe of steel with high fatigue strength for fuel injection systems, which method obviates the drawbacks of conventional production methods.

This object is attained by a method of making a high-pressure accumulator pipe as composite pipe of steel for pressures of up to 1800 bar and above with high static strength and fatigue strength for fuel injection systems with common rail systems for internal combustion engines, wherein a first inner pipe part is inserted into a second outer pine part with little clearance, and the inner pipe part is connected to the outer pipe part gap-free and by interference fit through mechanical forming, wherein the mechanical forminq includes a rolling-in process, wherein the inner pipe part is subjected to a ductile expansion, and the outer pipe part is subjected to an elastic expansion using an oversized rolling tool that is moved within the inner pipe part, and wherein a residual compressive stress adjusted to the operating pressure is applied to the inner pipe part after the forming process via the elastic resilience of the outer pipe part.

According to the teaching of the invention, a method is applied in which the high-pressure accumulator pipe is constructed as composite pipe, wherein a first inner pipe part is inserted into a second outer pipe part with little clearance, and the inner pipe part is connected to the outer pipe part gap-free and by interference fit by means of mechanical forming.

The mechanical forming involves a rolling-in process, wherein the inner pipe part is subjected to a ductile expansion, and the outer pipe part is subjected to an elastic expansion using an oversized rolling tool that is moved within the inner pipe part, and wherein a residual compressive stress adjusted to the operating pressure is applied to the inner pipe part after the forming process via the elastic resilience of the outer pipe part.

Rolling-in of pipes is a process which is based on the principle of reeling with oversized roller, when the pipe parts are assembled together. The inner pipe part is hereby locally expanded in a matched outer pipe part. The inner pipe part is plastically expanded by the rolling tool which moves axially through the inner pipe part with oversized roller.

When there is only a slight clearance between inner and outer pipe parts, the outer pipe part is elastically deformed by the ductile expansion of the inner pipe part so that a high surface pressure is established after the outer pipe part springs back in the joining gap to thereby realize an interference fit.

This method, which is not applied to date for the production of high-pressure accumulator pipes from composite pipes, could be adapted after extensive examinations for this application in such a manner that the demands on the surface can be met while at the same time production costs are lowered in comparison to conventional methods.

As a result of the very small roughness values in the range of $R_z \leq 1.0$ μm and $R_a \leq 0.2$ μm that can be realized by the method according to the invention, the stress concentrations and the notch effects which adversely affect the fatigue strength can be reduced to such an extent that the accumulator pipe has a long service life.

As a result of the residual compressive stress introduced by the rolling-in process onto the inner pipe part, the fatigue strength of the component is positively impacted. This may lead to the elimination of the autofrettage treatment, required by the conventional methods to increase the residual compressive stress onto the component, or of a complicated additional smoothing of the inner surface with this process in dependence in the requested demands so that the production costs can be further reduced. Also, the application of a complicated deep drilling process is no longer necessary.

As a consequence of the realization of the high fatigue strength of the high-pressure accumulator pipe while at the same time reducing the material costs, material combinations can be advantageously used to suit the varying demands on the inner and outer pipe parts.

As the demands on the forming capability of the inner pipe part during plastic forming are especially high when subjected to a rolling-in process, the inner pipe is advantageously made of a high-alloy steel with high ductility.

The following Table 1 shows, by way of example, the chemical composition for such a steel:

TABLE 1

| Chemical Analysis (%) | | | | | | | | |
|---|---|---|---|---|---|---|---|---|
| C | Si | Mn | P | S | Mo | Cr | N | Ni |
| ≤0.07 | ≤1.00 | ≤2.00 | ≤0.045 | ≤0.015 | ≤2.50 | 16.5-19.5 | ≤0.11 | 8.0-13.0 |

In contrast thereto, the forming stress for the outer pipe part is smaller because the pipe part is deformed only in the elastic range. For that reason, the outer pipe can advantageously be made of cheaper unalloyed or low-allow steel, as illustrated by way of example in Table 2:

TABLE 2

| Chemical Analysis (%) | | | | | |
|---|---|---|---|---|---|
| C | Si | Mn | P | S | Al |
| ≤0.22 | ≤0.55 | ≤1.60 | ≤0.04 | ≤0.04 | ≥0.02 |

When special demands need to be met, it is also possible to make both pipe parts of same material.

BRIEF DESCRIPTION OF THE DRAWING

Further features, advantages and details of the invention are explained in the following description of an exemplary embodiment with reference to the attached drawing, in which.

DETAILED DESCRIPTION OF PREFERRED EMBODIMENTS

The high-pressure accumulator pipe constructed as composite pipe includes a first inner pipe part 2 which is inserted in a second outer pipe part 1 with little clearance.

Figure 1:
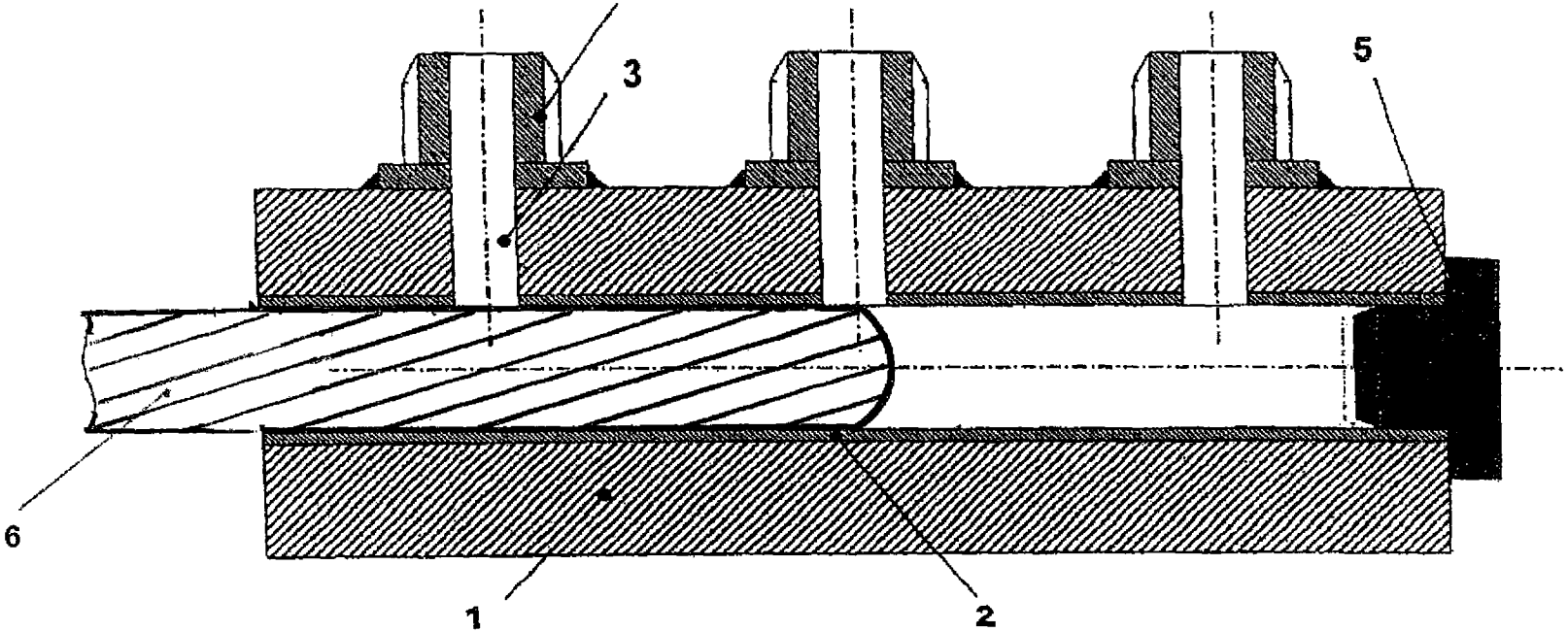
FIG. 1 shows a sectional view of a high-pressure accumulator pipe according to the invention after an inner pipe part has undergone an expansion.
Figure 2:
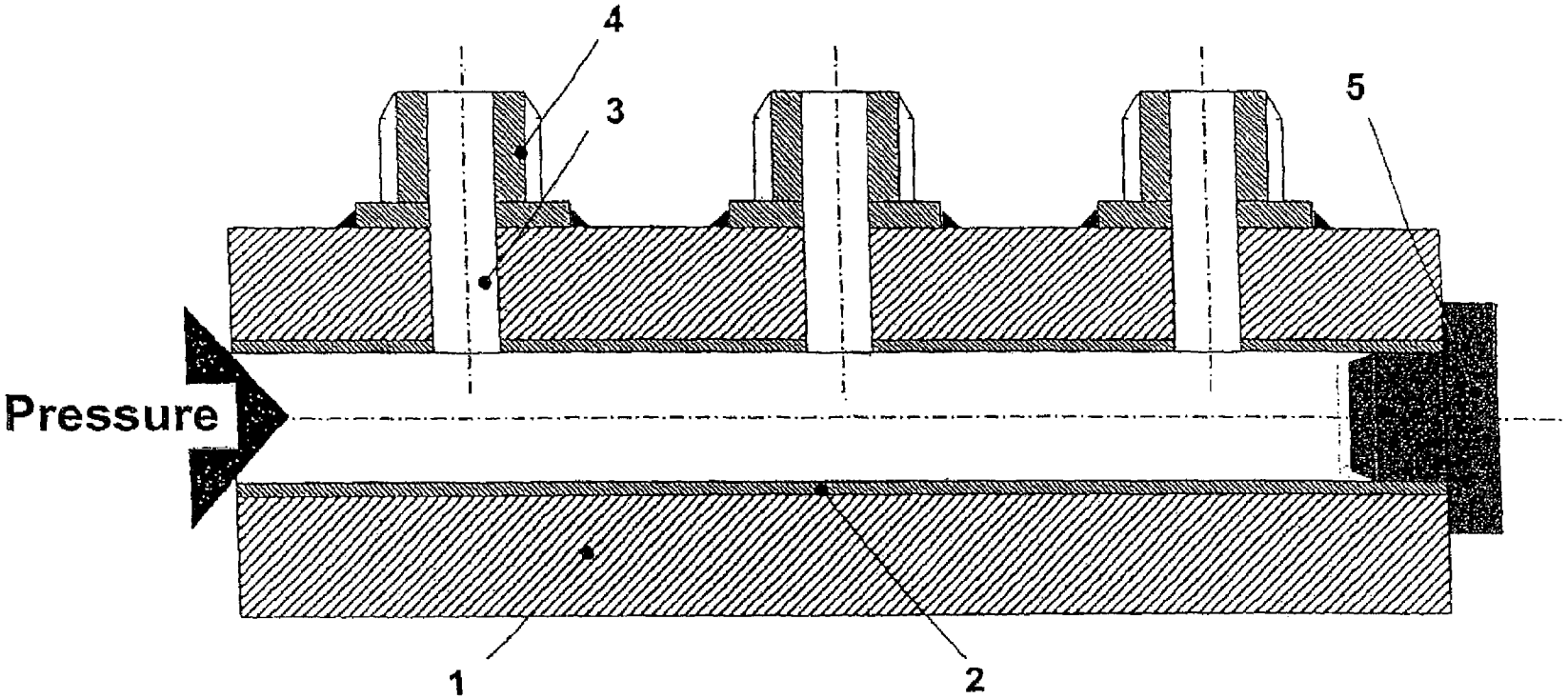
FIG. 2 shows a sectional view of the high-pressure accumulator pipe after the inner pipe part undergoes a pressure application.

In accordance with the invention, the composite pipe is produced through rolling-in the pipe using an oversized rolling tool 6 that is moved within the inner pipe part 2, as shown in FIG. 1. After the rolling-in process, as shown in FIG. 2, the inner pipe part 2 is acted upon with a residual compressive stress adjusted to the operating pressure via the elastic resilience of the outer pipe part 1, and the inner surface of the inner pipe part 2 has roughness values of $R_z$ in the range of ≤1.0 μm and a roughness $R_a$ in the range of ≤0.2 μ.

The outer pipe part 1 is configured relatively thick-walled and is made of an unalloyed or low-allow steel. The inner part 2 is configured relatively thin-walled and made of a high-alloy material which is suited to a plastic deformation during the rolling-in process of the pipe.

In order to be able to build up an internal pressure, the high-pressure accumulator pipe is provided on one end with a sealing plug 5.

To connect pressure lines for injection nozzles onto the high-pressure accumulator pipe, the composite pipe is provided with a corresponding number of radial through bores 3 for attachment on the outer pipe part 1 of coaxial connections 4 for the pressure lines.

What is claimed is:

1. A method of making a high-pressure accumulator pipe as composite pipe of steel for pressures of up to 1800 bar and above and exhibiting high static strength and fatigue strength for fuel injection systems with common rail systems for internal combustion engines, comprising the steps of:

inserting an inner pipe part into an outer pipe part with little clearance; and connecting the inner pipe part to the outer pipe part gap-free and by interference fit through mechanical forming by moving an oversized rolling tool within the inner piper part to thereby subject the inner pipe part to a ductile expansion and the outer pipe part to an elastic expansion wherein the inner pipe part is acted upon after the forming process by a residual compressive stress as the outer pipe part springs back.

2. The method of claim 1, wherein the inner and outer pipe parts are made of differently alloyed materials, with the outer pipe part being made of a high-strength material and the inner pipe part being made of a high-strength material with great forming capability.

3. The method of claim 1, wherein the outer pipe part is made of an unalloyed or low-alloy material, and the inner pipe part is made of a high-alloy material.

4. The method of claim 1, wherein the inner and outer pipe parts are made of a same material.

5. The method of claim 1, wherein the inner pipe part has a wall thickness which is smaller than a wall thickness of the outer pipe part.

6. The method of claim 1, wherein the inner pipe part has an inner surface which is defined by a roughness $R_z$ in a range of ≤1.0 μm and a roughness $R_a$ in a range of ≤0.2 μm.

* * * * *